United States Patent [19]

Pettit

[11] Patent Number: 4,722,554

[45] Date of Patent: Feb. 2, 1988

[54] ALTERNATIVE-VALUE PAPER REFUND FORM

[75] Inventor: Thomas G. Pettit, Palm Springs, Calif.

[73] Assignee: St. Ives Laboratories, Inc., Rolling Hills, Calif.

[21] Appl. No.: 900,737

[22] Filed: Aug. 27, 1986

[51] Int. Cl.[4] ..... B42D 15/00

[52] U.S. Cl. ..... 283/105; 283/56; 434/433

[58] Field of Search ..... 283/67, 56, 57, 58, 283/59, 102, 103, 104, 105, 106, 107; 273/139; 434/433

[56] References Cited

U.S. PATENT DOCUMENTS

| | | | |
|---|---|---|---|
| Re. 13,757 | 6/1914 | Smith | 283/100 |
| 876,794 | 1/1908 | Fritch et al. | 283/100 |
| 1,011,549 | 12/1911 | Yantis | 283/105 X |
| 1,068,118 | 7/1913 | Fitzpatrick | 283/58 |
| 1,104,310 | 7/1914 | Price | 283/57 X |
| 1,186,047 | 6/1916 | Sigsbee | 283/103 X |
| 1,330,217 | 2/1920 | Rice | 283/105 X |
| 1,429,423 | 9/1922 | Hamilton | 283/105 |
| 1,985,834 | 12/1934 | Lawrence | 283/105 X |
| 2,109,603 | 3/1938 | Worth | 273/139 X |
| 2,167,305 | 7/1939 | Kropp | 283/105 X |
| 2,279,164 | 4/1942 | Gettleman | 283/56 X |
| 2,309,398 | 1/1943 | Keller | 283/105 |
| 3,734,544 | 5/1973 | Fishkin et al. | 283/56 |
| 4,093,276 | 6/1978 | Debe | 283/1 R |
| 4,195,864 | 4/1980 | Morton et al. | 283/56 |

*Primary Examiner*—Paul A. Bell

*Attorney, Agent, or Firm*—Spensley Horn Jubas & Lubitz

[57] ABSTRACT

A single sheet paper form contains upon a first side the complete face of a negotiable instrument, nominally a check. Upon the opposite second side are printed one or more coupons in an image area which is partially overlapping of the oppositely juxtaposed image area of the check upon the first side. Severence of the check from the entire form is required in order to negotiate it, simultaneously dividing the coupon(s) and rendering it (them) unredeemable. Alternatively, severance of the one or more coupons from the entire form is required in order to redeem such coupon(s), simultaneously dividing the check and rendering it non-negotiable. The benefits promised, amounts, conditions, exercise dates, and other parameters of the check and the coupon(s) are completely independent. Further elements including a contest entry blank may be incorporated upon either side of the form, and either in alternative or non-alternative relationship to existing form elements of check and coupon(s).

13 Claims, 4 Drawing Figures

ALTERNATIVE-VALUE PAPER REFUND FORM

BACKGROUND OF THE INVENTION

1. Field of the Invention

The present invention relates generally to paper forms used in commerce.

2. Description of the Prior Art

Forms, particularly paper forms, used in commerce may embody patentable features. The present invention is embodied in a single sheet paper form. The holderuser of such form will be able to choose amongst alternative uses of such form, the choice of using the form for one purpose thereafter precluding the choice of using the form for an alternative purpose. Certain Prior art patents show paper forms enabling alternative usage. U.S. Pat. No. 978,407 to H. J. Smith for a "TRANSFER TICKET" shows a street car transfer ticket wherein one of two ends may be removed depending upon the direction in which the passenger is traveling. When the ticket is used for travel an appropriate one end is removed. After the removal of one end the ticket is useful for travel only in the direction indicated by the remaining parts.

U.S. Pat. No. 2,109,603 to S. Worth for a "SALES STIMULATOR" shows a card with tear-up windows which expose underlying indicia nominally bearing a relationship to goods (such as gum or cigars). The intended use of the cards is in mercantile promotions. One or more of the flaps indicia overlaying are removed in an irreversible operation. The holder of such card is then entitled to certain benefits, such as reception of a mercantile item, which become exposed.

Finally in a class of single-sided paper documents allowing alternative realizations, U.S. Pat. No. 3,734,544 to Fishkin for a "DUAL VALUE DOCUMENT" shows a document upon a sheet of flexible material, such as paper. The document is divided into a middle section plus two connected and detachable end sections. Similarly to the teaching of Smith, one end section must be detached in order to thereafter enable use of the remaining middle and attached end section of the document. Differential to the teaching of Smith, the "Dual Value Document" of Fishkin shows a first area of printing which occupies a first end section and part of the middle section, and a second area of printing which occupies the middle section and the second end section. Detachment of one end renders the printing which was partially upon that end invalid. The benefits described by printing occuring at each end of the ticket may be of a different character, and are not limited to benefits of such similar nature that they may be described by but one block of text (such as exists within the center section of the "Transfer Ticket" of Smith).

All the forms of Smith, Worth and Fishkin may be distinguished from the present invention in that they employ but one side of a paper form, whereas the present invention will be seen to employ two sides. Additionally, there is no suggestion that one of the choices which should, in the alternative, be made available to the holder of the form is to be a negotiable instrument, nominally a check. To envision how difficult, probably impossible, it would be to emplace a negotiable instrument, nominally a check, on a one side of a form while the same side simultaneously presents an alternative choice for the usage of such form, nominally a coupon, it is illustrative to consider the most general case, the "DUAL VALUE DOCUMENT" of Fishkin. Considering the "DUAL VALUE DOCUMENT" of Fishkin and conceptualizing that a negotiable instrument (the check) occupies one end plus some portion or all of the middle section, while the alternative use of the form occupies the second end plus some portion, or all, of the middle section, it immediately becomes apparent that the disparate nature of the two uses of a check and a coupon cannot be reconciled within a middle, overlapping, image area. If the check is printed entirely upon one end of the dual value document, and the coupon entirely upon the other end, then both the check and the coupon are simultaneously severable and usable, and do not present an alternative. Conversely, if the information necessary to validate use of the check is somehow attempted, in the middle section, to be overlapped with the information alternatively necessary to validate use of the coupon, then difficult, probably insurmountable, problems arise. These problems arise because the vastly different prescribed texts (respectively by banks and by merchants) for checks and for coupons preclude that both should share, upon a single side of a single form, a single text, or image, area.

A prior art teaching which shows the use of both sides of a paper form is U.S. Pat. No. 1,186,047 to R. Sigsbee for a "CHECK". Sigsbee describes a two-sided paper form. The form shows upon one side a discount order, which, when presented at the store of the vendor after proper cancellation [hereinafter described], indicates a certain percentage discount value. The percentage discount value bears a percentage ratio to the value of previously purchased goods. Alternatively, the same proper cancellation of the ticket effected at the time of the sale of goods accords another, possibly different, discount percentage ratio which may be applied, as a cash equivalent, to a purchase. Whereas the first discount accorded by the form is normally applied to the purchase of mercantile goods available at participating merchants, the second discount is normally applied to the purchase of tickets (such as car tickets, theater tickets, or train tickets) or accommodations at a central agency. A single punch, or validation, of the card at the time of a single purchase of goods constitutes cancellation and enables the "check" for all alternative purposes.

The "check" form of Sigsbee is distinguishable from the present invention in several aspects. Within Sigsbee, the values upon the form are not fixed at the time of printing, but are only later established by cancellation through punching at the time of purchase. If the form of Sigsbee, which contains a range of fields intended to encompass a like range of dollar purchases, were to be instead restricted to but a single dollar amount (as is the case with the present invention), then the entire employment of such form within a mercantile system would seemingly fail.

Also relative to the present invention, there is no automatic cancelling or destruction of the unused alternative at the time of a selection of a use of the Sigsbee "check" form. The holder/consumer makes a choice with the Sigsbee form whether to get a discount on goods by surrendering the "check", or to get an alternative discount on tickets by also surrendering the "check". Whoever comes to get the "check" as subsequent holder—either the goods retailer or the ticket seller —can still take the same Sigsbee "check", still valid, elsewhere to receive either the goods discount or the ticket discount. There is no disablement of the unused alternative of the "check" form by use of the other alternative.

Finally, and although the "discount order" and "merchant's ticket order" alternatives of the Sigsbee form are remotely analogous to coupons (although providing for a percentage, as opposed to a fixed amount, off from a specified purchase), Sigsbee does not suggest of how a coupon could be combined, in the alternative, upon a paper form with a negotiable instrument. Sigsbee suggests only of what often occurs in daily newspapers, when the clipping of a coupon upon one side of a newsprint sheet may come to sever, and destroy the validity, of another coupon upon the other side of the same sheet.

Additionally in the prior art, combination coupons exhibiting an overlapping central section are often placed in newspapers. Various strategies are employed. The coupon may sometimes be redeemed in one alternative usage for a greater value if a greater quantity of merchandise is purchased. Sometimes, the same quantity of merchandise being indicated in both alternative usages, a greater dollar value is obtained if the coupon is used early, then when, the alternative section being clipped, the coupon with an alternative expiration date is used later. All these considerations involved in combining coupons, whether upon the same or upon opposite sides of a paper piece, are not equivalent to considerations relevant to combining one or more coupons with a negotiable instrument such as a check.

SUMMARY OF THE INVENTION

The present invention is embodied in a form using both sides of a single sheet of paper. The form is nominally called a "refund" form because two entitlements which will be printed upon opposite sides of such single sheet paper form are respectively a negotiable instrument, nominally a check, and one or more coupons—either or all of which entitlements are often associated with manufacturers' or vendors' refunds, or rebates, to consumers. The form need not be used for a refund, or rebate, but is typically so used. The present invention is further described as "alternative-value" because it will present, upon the single sheet paper form, the alternative of a negotiable instrument, or, alternatively, one or more coupons. Exercise by the consumer holder of such form of a one of these alternative options will void the exercise of the other alternative option.

Specifically within the present invention, a one face of a negotiable instrument (which negotiable instrument might normally be considered to have two faces) payable at a first amount in money or moneys' worth is entirely printed exclusively upon a first side, called the obverse side, of a single sheet paper form. Nothing that is printed on the opposite, reverse, side of the single sheet paper form will interfere with the normal, correct, and accepted usage of such negotiable instrument if and when such instrument is severed, in a manner which will be described, from the single sheet paper form. Particularly supporting the normal usage, the second, reverse, face of the negotiable instrument will include an appropriate blank area within which such negotiable instrument may be endorsed, as upon deposit in a bank.

Further in the present invention, one or more coupons, redeemable for credit at an aggregate second amount (which may or may not equal such first amount) toward the purchase of prescribed goods, is (are) entirely printed exclusively upon a second side, the reverse side, of said single sheet paper form. Further, the one or more coupons are printed at an image area location upon such reverse side which is, and which only is, but partially overlapping of the diametrically opposed image area location of the negotiable instrument upon the obverse side of the single sheet paper form.

The partial juxtaposition of the images of a negotiable instrument upon an obverse side, and of one or more coupons upon a reverse side, of a single sheet paper form laid out in accordance with the present invention has the following effect. Severing of the negotiable instrument image area from the paper form is required to negotiate such negotiable instrument. This severing simultaneously makes that at least one of the one or more coupons becomes physically divided and consequently unredeemable. In the preferred embodiment of the invention, all of the coupons upon the reverse side become divided by the severing of the image area of the negotiable instrument, and are consequently and subsequently unredeemable.

Conversely in the present invention, severing of the image area(s) of the one or more coupons may be performed. This alternative severing is necessary to redeem the one or more coupons. This alternative severing makes that the negotiable instrument upon the obverse side of the form will become physically divided and consequently and subsequently non-negotiable.

Consequent to this printing of a negotiable instrument upon one side of a paper form within an image area which is but partially overlapping the image area(s) within which are printed one or more coupons upon the other side of such paper form; and consequent to the requirement that the negotiable instrument image area, or the image area of at least one of the one or more coupons, needs to be severed from such single sheet paper form in order to be respectively negotiated or redeemed; the paper refund form of the present invention presents two alternatives, only one of which may be exercised, to the bearer-holder of such form. The benefit of such a form, particularly for refunds, is that a manufacturer or a vendor remitting a cash rebate to consumers may, in the alternative, induce the consumer to forego a cash rebate and to use, as an alternative, one or more coupons to purchase additional product of the manufacturer or vendor.

Consequently, it is a first object of the present invention to provide a refund form upon which consumers may be given a negotiable instrument, tendering funds which they may be owed and/or expecting as a refund, simultaneously that such consumers are induced, as an exclusory alternative to the negotiation of the negotiable instrument, to use coupons contained within the refund form to purchase further products of the originator of the form and/or the drawer of the negotiable instrument.

It is a second object of the present invention that those alternative inducements presented on the two sides of an alternative value paper refund form constructed in accordance with the principles of the present invention are alternatives which are substantially independent in all aspects, save only that one of the alternatives upon a one side of the form will be a negotiable instrument. This means that the payees, dates, products, amounts, and benefits to be derived from exercise of the alternatives are substantially independent. For example, contest or sweepstakes entries may be substituted for coupons, or may appear in addition to coupons. Other combinations of three elements are possible, the essential principle being only that the use of some element(s) thereafter excludes the use of other elements.

It is a third object of the present invention to accord choice of action to the consumer receiving an alternative-value form. This choice of action works to stimulate the involvement, decision making, and action of the consumer. This positive consumer activity is desirable to the originator of the form, even if the consumer holder-bearer of such form ultimately chooses the alternative(s) offered by such form which are least beneficial to the originator of such form.

These and other objects of the present invention will be made increasingly clear in the following specification and acccompanying drawings.

DESCRIPTION OF THE PREFERRED EMBODIMENT

Figure 1B:
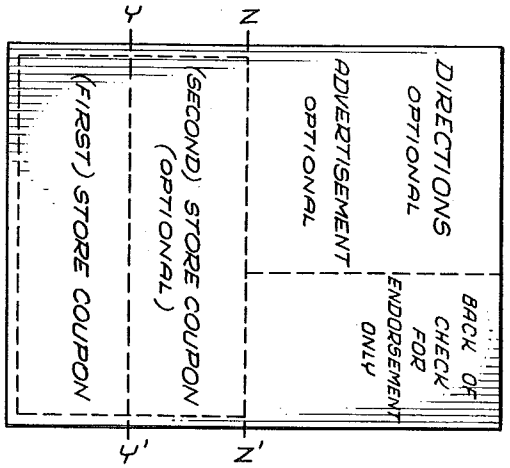
FIG. 1*b* shows a diagrammatic representation of a second, reverse, side of the preferred embodiment alternative-value paper refund form of the present invention.
Figure 1A:
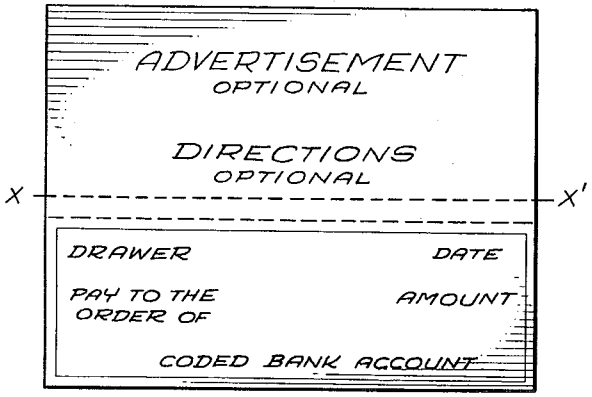
FIG. 1*a* shows a diagrammatic representation of a first, obverse, side of the alternative-value paper refund form of the present invention.

The present invention of an alternative-value paper refund form is shown in respective obverse and reverse sides in FIG. 1*a* and FIG. 1*b*. Within the obverse side shown in FIG. 1*a* appear two sections, the essential one of which sections is a negotiable instrument illustrated to be in the form of a common check. Such a negotiable instrument contains all required fields, and it may contain additional information and/or logos. In particular, it is illustrated that the DRAWER of the negotiable instrument should be shown. The negotiable instrument will be printed PAY TO THE ORDER OF, with a following field normally printed to contain a named entity and/or a bearer. The DATE of the drawing of the negotiable instrument is normally given. It may be additionally printed (not shown) that the negotiable instrument is to expire within a certain number of days from the drawing date, or at a fixed future time certain. The AMOUNT in dollars and cents of the negotiable instrument is definitively stated. The code identification of the bank to which the negotiable instrument is drawn will normally appear within its conventional field (not shown) at the upper right of such negotiable instrument, and the number of the bank account (often magnetically encoded) upon which such negotiable instrument is drawn will normally appear in machine readable characters along the lower periphery of the negotiable instrument. Logos, water markings, imprintings, and/or other design features may appear upon the negotiable instrument.

The negotiable instrument upon the obverse side of the form is complete in all respects, save only that it should be noted that if, as illustrated, the negotiable instrument is particularly a check then an area is preserved on the opposite, reverse, side for the endorsement of the check. Referring to FIG. 1*b*, such area is visible and is labeled BACK OF CHECK FOR ENDORSEMENT ONLY. In actuality, this area is substantially blank and presents more than adequate room for the check to be endorsed by a succession of holders without confusion or crowding of signatures.

Appearing within the remaining field of the obverse side shown in FIG. 1*a* is room for an ADVERTISEMENT (optional) and/or DIRECTIONS (optional). The same field, which may be filled with identical and/or equivalent content, is shown to likewise occur in the reverse side illustrated in FIG. 1*b*.

Amongst the fields printed upon the reverse side of the alternative-value paper refund form of the present invention shown in FIG. 1*b* is the essential (FIRST) STORE COUPON. It should be noted that, although this (FIRST) STORE COUPON needs not appear at the precise location illustrated, it is located at a reverse side image area location which is, and which only is, but partially overlapping of the diametrically oppositely disposed obverse side image area location of the negotiable instrument (shown in FIG. 1*a*). The requirements to use the form, which requirements are explained in directions appearing on either one or upon both sides, demand that the form needs either be severed along axis X-X' or along axis Y-Y'. The form is severed along axis X-X' in order to extract, and subsequently to negotiate the negotiable instrument shown (in the first face thereof) upon the obverse side. Elsewise, as an exclusive alternative, the form is severed along axis Y-Y' in order to extract, and subsequently to redeem, the (FIRST) STORE COUPON. Severing of the form to extract one of the items, either the negotiable instrument or the coupon, which are presented upon opposite sides of the form will destroy by severing the validity of the item not selected.

Also illustrated in FIG. 1*b* upon the reverse side of the preferred embodiment alternative-value paper refund form of the present invention is the (SECOND) STORE COUPON (OPTIONAL). This image area is optional. It presents a second store coupon, which may or which may not be related to the first store coupon either in the prescribed goods for which such is redeemable and/or in amount, which may be severed from the form, and subsequently redeemed, by the bearer-holder. By the particular location of the image areas shown in FIG. 1*b*, this severing of the second coupon is again in lieu of severing the negotiable instrument shown in FIG. 1*a* from such form. Obviously, the severing of the (SECOND) STORE COUPON (OPTIONAL) occurs along both axis Y-Y' and axis Z-Z'. Other combinations of the numbers of, and image area locations for, the coupons employed are obviously possible.

The preferred embodiment of the present invention shown in FIG. 1 should be held to be an illustration of fundamental principles of the invention only, and not the sole or only structure which can be created in accordance with such principles. For example, it is possible to emplace a second, or a subsequent, coupon upon the reverse side (shown in FIG. 1*b*) within the image area now labeled DIRECTIONS (OPTIONAL) ADVERTISEMENTS (OPTIONAL). Even if this additional coupon were able to be severed without dilaterious effect upon either the negotiable instrument illustrated in FIG. 1*a*, or the store coupon shown in FIG. 1*b*, this additional coupon might well be used by a manufacturer wishing to induce the redemption of the store coupons as opposed to the negotiation of the check. The manufacturer might hope that, in the process of extracting the additional coupon, the consumer would continue to clip the (FIRST) STORE COUPON and/or the (SECOND) STORE COUPON (OPTIONAL), thereby dividing the check and destroying its negotiabilty.

Certain further details in the implementation of the alternative-value paper refund form of the present invention may be readily visualized even if not explicitly shown in FIG. 1*a* and FIG. 1*b*. Note that the obverse side position at which the name of the payee, which may be a particular individual named entity, will be printed in the check of FIG. 1*a* corresponds to a particular positional location upon the reverse of the form shown in FIG. 1*b*. If the name of a particular, individually named, payee is printed of an appropriate position in the check upon the obverse side of the single sheet paper form, then, by and upon severing the paper form to extract the store coupon(s), the printed name will still appear upon the obverse side of the coupon(s). This has utility in according that if the coupon(s) is (are) thereafter redeemed then (1) the particular named individual who was originally in possession of the alternative-value paper refund form may be identified, B2) that individual's choice of the coupon redemption as opposed to the negotiation of the check may be tubulated for statistical purposes, and (b 3) it may be positively known that the check portion of a particular alternative-value paper refund form is no longer valid and outstanding for negotiation.

Further regarding details of the implementation of the alternative-value paper refund form of the present invention, it may be noted that the negotiable instrument appearing on the obverse side of FIG. 1*a* may be drawn against the account of the selfsame entity which is the offeror of the coupons for prescribed goods which are printed upon the reverse side shown in FIG. 1*b*, or such entities may be unrelated. The amount(s) to which the coupons printed upon the reverse side shown in FIG. 1*b* are redeemable, either individually or collectively, may be either less than, equal to, or greater than the amount at which the check printed upon the obverse side shown in FIG. 1*a* is negotiable. Normally the issuer of the alternative-value paper refund form favors the redemption of the coupon(s) over the negotiation of the check. Consequently, the dollar amounts of each coupon, and/or collectively of all coupons, which appear upon the reverse side of the form and which are severable from the form will normally at least equal, and probably exceed, the value at which the check is negotiable.

As a further detail in the implementation of the alternative-value paper refund form of the present invention, it may be noted that the coupon(s) appearing in FIG. 1*b* exhibit all characteristics normally exhibited by coupons. These characteristics may include that the coupons may be good only for a certain time, that they may be good for redemption on one or more specifically prescribed goods, that they may be redeemed only at certain specific locations, and/or that they may be redeemed only by mail-order purchase. It is even possible to have a combinatorial coupon, such as is suggested by the prior art teaching of U.S. Pat. No. 978,407 to H. Smith and by U.S. Pat. No. 3,734,544 to B. Fishkin, reside in its entirety within a coupon area upon the reverse side of the alternative value paper refund form shown in FIG. 1*b*.

Many diverse and exotic combinations achievable in accordance with the principles of the present invention must be evaluated not for offering complexity for complexity's sake, but for their effect in inducing a desired behavior of the bearer-holder. The induced behavior concerns the choices exercisable with the alternative-value paper refund form when such form is held within the hands of a consumer bearer-holder. For background, it should be noted that there exist many complex advertising scenarios involving the licking of envelopes, the extraction of perforated stamps, and the emplacement of stamps onto forms. These scenarios illustrate that consumer involvement, and consumer choice, may be engendered, and shaped, to a greater or to a lesser extent dependent upon promps built into the design of those paper forms with which the consumer deals. It is obvious that the present invention permits of diverse combinations. Some of these combinations may be more efficacious than others in inducing the desired responses and behaviors by the holder-bearer of the alternative-value paper refund form.

Figure 3:
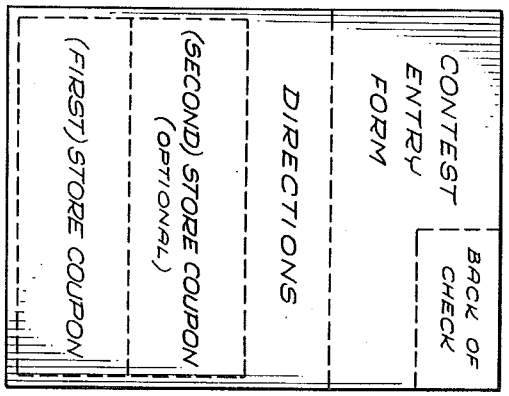
FIG. 3 shows a variant printing of the reverse side of the alternative-value paper refund form of the present invention.
Figure 2:
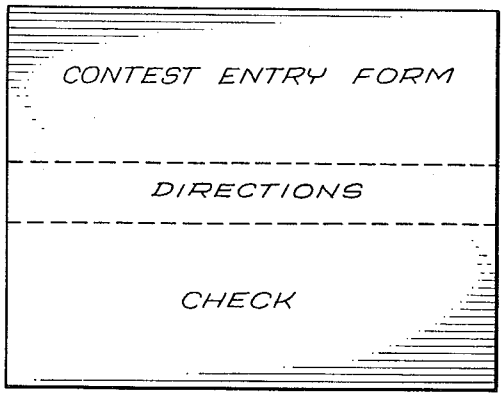
FIG. 2 shows a diagrammatic representation of a variant printing of the obverse side of the paper refund form of the present invention.

Two particularly efficacious major variants of the present invention are shown in FIG. 2, illustrating an alternative to that obverse side shown in FIG. 1*a* of the alternative-value paper refund form of the present invention, and in FIG. 3, illustrating an alternative to the reverse side shown in FIG. 1*b* of the alternative-value paper refund form of the present invention. Both FIG. 2 and FIG. 3 show that a CONTEST ENTRY FORM may be incorporated, as a major third element, combinatorily within the existing structure of the alternative-value paper refund form of the present invention. Considering the alternative obverse side illustrated in FIG. 2, severance of the CONTEST ENTRY FORM (which is required for entry of the contest) destroys both the (FIRST) STORE COUPON and the (SECOND) STORE COUPON (OPTIONAL) shown in FIG. 1*b*. Severance of the CONTEST ENTRY FORM shown in FIG. 2 has no effect upon the negotiability of the CHECK prihted within another image area on the same, obverse, side of the alternative-value paper refund form.

Alternatively, and considering the FIG. 3 representation of an alternative reverse side to the form of the present invention, if the CONTEST ENTRY FORM is appropriately printed upon the reverse side of the form, then the severance of the CONTEST ENTRY FORM required in order to use the entry form to enter a contest will destroy (by dividing) the check appearing on the obverse side of the form (illustrated in FIG. 1*a*). By the word "contest" is meant a sweepstakes, a drawing, a lottery, or a contest of any nature whatsoever. It includes contests when entry requires only the deposit or mailing of a ticket, or contests where entry entails further involvement of the entrant such as by the completion of a phrase, puzzle, or form.

The generalized teaching of FIG. 2 and of FIG. 3 is that a third image area element, of a substantially different form than either a check or a coupon, may be placed compatably within the existing structure of the present invention of an alternative-value paper refund form. Such a third element, suggested to be an CONTEST ENTRY FORM, may offer an inducement to the severance of the form along certain physical and functional lines. This inducement may be substantially different than the accompanying inducement(s) that may be present upon the same side of the form. For example, if the issuer wishes to induce redemption of the coupons, and incidentally and/or relatedly the entrance into a contest via the CONTEST ENTRY FORM, then the reverse side representation of FIG. 3 would be used in conjunction with the obverse side representation of FIG. 1*a* to create an alternative-value paper refund form.

The preferred embodiment alternative-value paper refund form shows further detail characteristics. The negotiable instrument printed upon the obverse side of the form is nominally a check, which is further printed to be payable to an unnamed bearer or to a particular individual named entity. If the check is printed to be payable to a particular individual named entity, then the image area location of the check upon the obverse side of the single sheet paper form will be positioned diametrically opposite the image area location upon the reverse side within which appears at least one of the one or more coupons appearing upon such reverse side. This juxtaposition has the effect that if the bearer-holder chooses to sever and redeem the at least one coupon, then the manufacturer, or vendor, ultimately receiving the redeemed coupon will, by reference to the address of a particular individual named entity printed upon the reverse side of that coupon, have a record of the origin of that coupon. The manufacturer or vendor will also know that the redeemed coupon arose as part of an alternative-value paper refund form wherein the holder-bearer of such form chose not to negotiate the check within the form.

Further particular aspects of the alternative-value paper refund form of the present invention include the following. The negotiable instrument appearing upon the obverse side may be printed to be drawn against the account of the selfsame entity which is the offeror of the prescribed goods for which coupons appearing on the reverse side are redeemable. Alternatively, the offeror of the prescribed goods may be unrelated to the drawer of the negotiable instrument.

The individual amount(s), or an aggregate second amount, of a coupon(s) printed upon the reverse side may be in value less than, equal to, or greater than the first amount of the negotiable instrument printed upon the obverse side. Normally, due to an advantage to the originator of the alternative-value paper refund form occurring from the redemption of the coupon(s) for additional goods, the second-amount redemption value of the coupon(s) will be at least equal to, and often greater than, the first-amount payable value of the negotiable instrument.

As a further alternative, one or more of the coupons upon the reverse side may be printed to be redeemable for credit only upon the mail-order purchase of certain prescribed goods, or of any goods available from a single mail order source.

The dates of both the coupons and the negotiable instrument are independently adjustable: often the coupons may be printed to be redeemable until a first date which is later than a second date printed upon the negotiable instrument, after which such second date the negotiable instrument will be void.

A major variant of the present invention exists in that—the utility of opposite side alternative offering of a negotiable instrument or of a coupon(s) being recognized—there may be additional, third, elements incorporated into the structure of the present invention. In particular, a contest (wherein such word "contest" is held to mean a drawing or a sweepstakes or a lottery or a contest of any nature) entry blank may be implaced upon the form. This contest entry blank may be emplaced either upon the reverse side (without interference to the coupons upon that side) or, alternatively, upon the obverse side (without interference to the negotiable instrument upon that side) of the alternative-value paper refund form. The contest entry blank, on whatsoever side it appears, will normally also be required to be physically severed from the paper refund form in order to be of force and effect to enter a contest. This severing of the contest entry blank may be performed so that the image area which is upon the opposite side of the single sheet paper form should become severed. Each severance renders the corresponding item, the negotiable instrument or the coupon, unusable. This "triple combination" obviously presents an enhanced opportunity to further induce the holder-bearer of the alternative-value paper refund form to exercise one option in the severance and use of the form over another option.

Of course, some of the effects of a that contest entry blank which is emplaced upon the coupon side of the alternative-value paper refund form may be obtained by making the coupon(s) itself (themselves) effective for contest entry upon its (their) redemption. However, it may be desirable to have a second mechanism for contest entry, such as by mail, which does not entail the redemption of the coupons. This second mechanism for contest entry will independently destroy, by physically severing, the negotiable instrument equivalently to, and as if, the coupons were severed and redeemed.

In the particular application of an alternative-value paper refund form of the present invention, certain known means to facilitate the severing of paper may be incorporated within the form in a particular manner which is interactive with the purpose of the form to induce alternative choice. The periphery of the image area of the one face of the negotiable instrument upon the obverse side of the single sheet paper form may be perforated, or the periphery of the image area of the one or more coupons upon the reverse side of the single sheet paper form may be perforated, or both image areas may be perforated in order to facilitate the severing of the form to occur by manual tearing. Alternatively, the image area of the negotiable instrument, or the image area of the coupons, or the image area of both the negotiable instrument and the coupons may be outlined, including by dashed or by dotted line, in order that guidance may be provided to the severance of the form by cutting as with scissors. Perforating and outlining may be selective in order to influence the choice of the holder/bearer.

Still further details of the implementation of the alternative-value paper refund form of the present invention may be readily visualized. Those image area(s), nominally the image of the negotiable instrument, upon the obverse side of the single sheet paper form may be perforated at the periphery. Those image area(s), nominally the store coupon(s), upon the reverse side of the single sheet paper form may be perforated at the periphery. All that image areas upon both the obverse and reverse sides may be bounded by perforations in order to facilitate the severing of such image areas from the entire single sheet paper form to occur by the mechanism of hand-held tearing. Lines may be drawn to define the image area of the negotiable instrument upon the obverse side of the alternative-value paper refund form, or lines may be drawn to define the image area of the store coupon(s) upon the reverse side of the alternative-value paper refund form, or lines may be drawn to define all image areas upon both the obverse and reverse sides of the form.

The form may be folded in a preferred direction, either so as to produce no crease in the image area of the negotiable instrument shown upon the obverse side of the form, or so as to produce no crease in the image area of the store coupon(s) shown upon the reverse side of the form. If it is desired by the offeror of such alternative-value refund form that the store coupon(s) should be preferentially redeemed (as opposed to the negotiation of the check), it may well be desired that the form should be folded so that the store coupon(s) are creased at their boundaries, facilitating severance, whereas the negotiable instrument upon the obverse side is creased across its face, reducing the ease and facility of both its severance and of its subsequent handling.

As a final aspect of the present invention, it is obvious that a particular method will be employed by the holder/manipulator of such alternative-value paper refund form (more particularly of two identical such alternative-value paper refund forms). This particular method will not be realizable upon other than an alternative-value paper refund form constructed in accordance with the teaching of the present invention. This method entails first cutting an image of an negotiable instrument from and upon a first side of a first piece of paper while simultaneously physically severing the image of a coupon upon a second side of the first piece of paper. Subsequently the cut image of the negotiable instrument is negotiated while the remainder of said first piece of paper is disregarded, there being no complete image, including the image of any coupon, thereupon such remainder of the first piece of paper. The method further continues with the second cutting of an image of a coupon from and upon a second side of a second piece of paper, identical to said first piece of paper, while simultaneously physically severing the image of the negotiable instrument upon the first side of the second piece of paper. Subsequently, the cut image of the coupon severed from the paper is redeemed while the remainder of the second piece of paper is discarded, there being no complete image, including any image of a negotiable instrument, thereupon such remainder of the second piece of paper. Although this procedure of first cutting, negotiating, first discarding, second cutting, redeeming, and second discarding is rather convolute, it is apparent that some special properties of the workpiece (the alternative-value paper refund form) must be evident in order to support of the method. An equivalent method is not likely to exist unless an equivalent workpiece can be identifed.

In consideration of the preceding teaching, of the discussion of the diverse attributes realizable in the detailed implementation of the present invention, and of the significant variants in the implementation of the present invention, the following claims should be interpreted broadly.

What is claimed is:

1. A single piece of paper comprising:

a first side bearing a first image of a form; and a second reverse side including a portion bearing a second image of a form said images partially overlapping, and positioned such that detachment of the portion bearing the second image mutilates the first image.

2. A single piece of paper as described in claim 1, wherein the first image occupies a portion of the first side and the first image is positioned such that detachment of the portion bearing the first image mutilates the second image.

3. The single piece of paper described in claim 2, wherein the portion of the reverse side that bears the second image is separated from the remainder of the reverse side by a first dividing line.

4. The single piece of paper described in claim 3, wherein the first dividing line includes serrations adapted for easy separation of the first portion from the remainder of the paper.

5. The single piece of paper described in claim 4, wherein the portion bearing the first image is separated by serrations from the remainder of the first side.

6. A single piece of paper described in claim 1, wherein the first image is an image of a check and a portion of the second reversed side is suitable for endorsing a check.

7. The piece of paper described in claim 1, wherein the portion of the reverse side bearing the second image includes a third image of a form positioned such that detachment of either the second or third image mutilates the first image.

8. A single piece of paper exhibiting particularly juxtaposed image areas of particular images upon its two sides, said single piece of paper comprising:

a first side printed with the image of a check within a first image area, which first image area is smaller than the entire area of said piece of paper;

a second side printed with the image of coupon within a second image area, which second image area is smaller than the entire area of said piece of paper;

wherein said first image area upon said first side is partially, and only partially, juxtaposed with said second image area upon said second side, neither image area being entirely juxtaposed within the image area of the other.

9. A single piece of paper exhibiting particularly juxtaposed image areas of particular images upon its two sides, said single piece of paper comprising:

a first side printed with the image of a check within a first image area, which first image area is smaller than the entire area of said piece of paper;

a second side printed with the image of a contest entry from within a second image area, which second image area is smaller than the entire area of said piece of paper.

wherein said first image area upon said first side is partially, and only partially, juxtaposed with said second image area upon said second side, neither image area being entirely juxtaposed within the image area of the other.

10. A planar piece of material comprising:

a first side printed with a first image of a form; and a reverse side printed with a second image of a second form within a portion of the reverse side, wherein the two images only partially overlap and the two images are selected from group consisting of images of negotiable instruments, coupons, tickets, tear-up windows, discount orders, merchant ticket orders, and entry forms.

11. The piece of material described in claim 10, wherein the reverse side bears a third image of a form positioned such that detachment of the third image does not mutilate the first image or the second image.

12. The piece of material described in claim 10, wherein the reverse side bears a third image positioned such that detachment of the third image mutilates the first image but does not mutilate the second image.

13. The planar piece of material described in claim 10, wherein directions are printed on the reverse side outside of the portion.

* * * * *